United States Patent [19]

Ohno et al.

[11] Patent Number: 5,005,993

[45] Date of Patent: Apr. 9, 1991

[54] ELECTROTHERMAL PRINTER WITH A RESISTIVE INK RIBBON AND DIFFERING RESISTANCE CURRENT RETURN PATHS

[75] Inventors: Tadayoshi Ohno; Hitoshi Nagato, both of Kawasaki; Tsutomu Kanai, Yokohama, all of Japan

[73] Assignee: Kabushiki Kaisha Toshiba, Kawasaki, Japan

[21] Appl. No.: 517,452

[22] Filed: May 4, 1990

Related U.S. Application Data

[63] Continuation of Ser. No. 225,787, Jul. 29, 1988, abandoned.

[30] Foreign Application Priority Data

Jul. 31, 1987 [JP] Japan ..... 62-190365
Nov. 10, 1987 [JP] Japan ..... 62-282012

[51] Int. Cl.[5] ..... B41J 2/39
[52] U.S. Cl. ..... 400/120; 346/76 PH
[58] Field of Search ..... 400/118, 119, 120; 346/76 L, 76 PH

[56] References Cited

U.S. PATENT DOCUMENTS 4,329,075 5/1982 Applegate et al. ..... 400/120
4,345,845 8/1982 Bohnhoff et al. ..... 400/120
4,420,758 12/1983 Tabata et al. ..... 400/120
4,484,200 11/1984 Tabata et al. ..... 400/120
4,556,891 12/1985 Matsushita ..... 346/76 PH
4,558,963 12/1985 Applegate et al. ..... 400/120

FOREIGN PATENT DOCUMENTS 0009595 4/1980 European Pat. Off. .
0042950 1/1982 European Pat. Off. .
2757137 6/1979 Fed. Rep. of Germany ..... 400/120

*Primary Examiner*—David A. Wiecking
*Attorney, Agent, or Firm*—Oblon, Spivak, McClelland, Maier & Neustadt

[57] ABSTRACT

In an electrothermal printer with a resistive ink ribbon, ink ribbon is fed in a predetermined direction and is contacted with a recording electrode and first and second return electrode which are located upstream and downstream of the predetermined direction with respect to the recording electrode. The first return electrode is directly connected to the ground and the second return electrode is connected to the ground through a resistor. A signal current is supplied from the recording electrode to a conductive layer of the ink ribbon through a resistive layer and the signal current supplied to the conductive layer is supplied to the return electrodes through the resistive layer. Heat is generated at a portion of the ink ribbon, which is contacted with the recording electrode and is applied to the ink layer through the conductive layer, thereby printing an ink of the ink layer to a paper.

21 Claims, 5 Drawing Sheets

ELECTROTHERMAL PRINTER WITH A RESISTIVE INK RIBBON AND DIFFERING RESISTANCE CURRENT RETURN PATHS

This application is a continuation of application Ser. No. 225,787, filed on July 29, 1988, now abandoned.

BACKGROUND OF THE INVENTION

1. Field of the Invention

This invention relates to an apparatus for transferring ink from a resistive ink ribbon to a recording medium, by generating heat in the ink ribbon, thereby recording data on the recording medium, and more particularly, to a so-called "thermal recording printer with a resistive ink ribbon."

2. Description of the Related Art

An apparatus, generally known as a "electrothermal recording printer with a resistive ink ribbon", transfers ink from an ink ribbon to a recording medium, by generating heat in the ink ribbon and thereby melting the ink. The printer can print data on sheets of ordinary paper, without making much noise, and can operate very reliably. For these advantages, the thermal recording printer is used as hard copy printers for use in various OA (Office Automation) apparatuses such as personal computers, word possessors, and color printers. The thermal recording printer is disadvantageous in two respects. First, the ink ribbon is liable to be cut during use. Secondly, the printer cannot print image data in sufficient quality, on sheets of coarsely textured paper such as ppc paper or bond paper.

FIG. 1 is a schematic view showing an electrothermal printer of the known type. In this printer, ink ribbon 1 is comprised of electrically resistive base film 2, electrically conductive layer 3 made of aluminum, and solid ink layer 4 coated on conductive layer 3. Ink layer 4 will melt, soften, or sublime when heated. Ink ribbon 1 is fed in the direction of arrow A by means of a ribbon-feeding mechanism (not shown).

As is shown in FIG. 1, the electrothermal printer comprises data-recording electrode 5, signal-generating circuit 6, and return electrode 7. Electrodes 5 are pin-shaped and arranged parallel to one another. It can be moved in the direction of arrow C, and is electrically coupled with signal-generating circuit 6. Return electrode 7, which is moved along with electrode 5, is connected to the ground and located downstream of the ribbon-feeding direction (arrow A). Return electrode 7 is coupled to follow roller 8 by the ribbon-feeding mechanism. Follow roller 8 contacts ink ribbon 1; it is rotated as the mechanism feeds ink ribbon 1 in the direction of arrow A.

To print data on recording paper 9 located below ink ribbon 1, signal-generating circuit 6 supplies data signals to data-recording electrode 5. Electrode 5 supplies ink ribbon 1 with the currents corresponding to the data signals. These currents (hereinafter referred to as "data currents") flows through resistive base film 2 into conductive layer 3, and flow from layer 3 to return electrode 7 through resistive base film 2, as is shown by arrow B. As the data currents flows from electrode 5 through base film 2, Joule heat is generated in the limited portions of ink ribbon 1 which are located below electrode 5. These portions of ribbon 1 are heated to 200° C. or more, whereby those portions of ink layer 4 which are on these portions of ribbon 1 are softened or melted. As a result, the ink is transferred from ribbon 1 onto recording paper 9.

As has been described above, the data currents also flow to return electrode 7 through resistive base film 2, and change into Joule heat. This heat is not sufficient to melt or soften solid ink layer 4, since that surface of return electrode 7 which contacts the ribbon 1 is much larger than that surface of each data-recording electrode 5 which contacts ribbon 1. Thus, return electrode 7 does not operate to transfer ink onto recording paper 9.

Data-recording electrode 5 is moved, along with return electrode 7, in the direction of arrow C. While electrode 5 is thus moved, they supply data currents to ink ribbon 1, in response to the data signals output from signal-generating circuit 6. Therefore, the ink is continuously transferred from ribbon 1 onto recording paper 9, whereby data, such as images and characters, are reproduced on recording paper 9.

As has been described, it is within ink ribbon 1 that heat is generated within ink ribbon 1 during the use of the thermal recording printer. Thus, the heat is fast transmitted to solid ink layer 4, and the printer can record data on paper at a speed higher than ordinary thermal printers having a thermal head which applies heat to an ink ribbon. Since heat is generated within ink ribbon 1, it is applied in its entirely to solid ink layer 6, thus heating layer 6 to a high temperature. Hence, solid ink layer 4 can be made of material having a high melting point or a high sublimation point.

Resistive ink ribbon 1 is made of three layers, and is more difficult to manufacture and, hence, more expensive than the ink ribbon for use in the ordinary thermal printers, which is comprised of two layers, i.e., an electrically resistive base film and a solid ink layer. Another drawback inherent in the resistive thermal printer is that each portion of ink ribbon 1 required for printing one line of characters cannot be shorter than the line of characters, and the running cost of the printer is, thus relatively high.

A method is disclosed in U.S. Pat. No. 4,558,963 in which an ink ribbon is fed at low speed, in order to use the ink ribbon more efficiently in such a resistance thermal printer as is shown in FIG. 1, and thus to lower the running cost of the printer. Since the tape-feeding speed is low, the ink ribbon will likely be cut. Also, the low speed of feeding the ribbon results in the following problem.

As been explained, in the electrothermal printer shown in FIG. 1, the data currents applied to ink ribbon 1 change into Joule heat in those portions of solid ink layer 4 which are located below electrode 5. Since ribbon 1 is fed slowly, a great amount of heat is generated in these portions of ink layer 4. Those portions of conductive layer 3 and base film 2 which receive this heat are heated to 200° C. or more. As a result, the heated portions of layer 3 may be oxidized or cracked, and the heated portions of base film 2 may shrink. If this happens, all conductive layer 3 rendered almost non-conductive, except for both lateral edges which are not located under electrodes 5. The data currents flow concentratedly through the thin lateral edges of a conductive layer 3 into that portion of base film 2 which contacts return electrode 7. When electrode 7 contacts any shrinked portion of resistive base film 7, which is narrower than unshrinked portions, a great amount of Joule heat is generated in the shrinked portion. This heat is transferred to the unshrinked portions of film 2, inevitably softening these portions and also the remaining portions of solid ink layer 3.

Consequently, ink ribbon 1 is cut at such a softened portion of base film 2, overcome by the tension which is applied on that portion of ribbon 1 which extends between data-recording electrodes 5, on the one hand, and return electrode 7, on the other. Moreover, ribbon 1 may be adhered to follow roller 8 by the remaining ink layer 4, now softened and thus viscous, and it may eventually taken up around roller 8. In the worst case, it may be cut at a shrinked portion of base film 2, which is positioned between roller 8 and electrodes 5.

The slower the ribbon is fed, thereby to use the ribbon efficiently, the greater the possibility that the ribbon is cut. Hence, it is practically impossible to apply the method disclosed in U.S. Pat. No. 4,558,963, wherein an ink ribbon is fed at low speed, to the resistance thermal printer having the structure shown in FIG. 1.

SUMMARY OF THE INVENTION

It is accordingly the object of the present invention to provide an electrothermal recording apparatus with a resistive ink ribbon, which can record data at high speed.

Furthermore, it is another object of the present invention to provide an electrothermal recording apparatus with a resistive ink ribbon, which can efficiently use ink ribbon, without cutting the ink ribbon during use.

During the use of the known electrothermal printers, the ink ribbon is often cut. The inventors hereof have conducted experiments on these printers, and have found that there are two causes of the cutting of the ribbon.

The first cause is the electrical resistance of conductive layer 3 of ink ribbon 1 (See FIG. 1). Since the resistance of conductive layer 3 is far lower than that of resistive base film 1, the currents applied from data-recording electrodes 5 to ribbon 1 flow through layer 3 to return electrode 7, as is represented by arrow B in FIG. 1. Conductive layer 3, which is a thin aluminum layer (about 1 μm) vapor-deposited on base film 2, has a considerable resistance. Therefore, as the currents flow through layer 3 from electrode 5 to return electrode 7, a voltage drop occurs; some part of these currents change into heat. Thus, the more electrode 5 simultaneously supplies currents to ink ribbon 1, or the greater current is supplied from each electrode 5 to record data at a higher speed, the greater heat will be generated in that portion of conductive layer 3 which extends between electrodes 5 and return electrode 7. Even though the heat generated in those portions of solid ink layer 4 which are located below data-recording electrode 5 is dispersed within ribbon 1 as ribbon 1 is fed toward return electrode 7, the temperature of that portion of ribbon 1 which is reaching follow roller 8 is considerably high due to the heat generated in conductive layer 3. Consequently, solid ink layer 4 remaining on this portion of ribbon 1 is softened and viscous, and adheres ribbon 1 to roller 8, whereby ink ribbon 1 is taken up around roller 8 and eventually cut in the vicinity of follow roller 8.

The second cause of the cutting of the ink ribbon is the heat generated in those portions of solid ink layer 4 which are located below data-recording electrode 5, in order to record data on recording paper 9. The heat generated in solid ink layer 4 destroys conductive layer 3 or renders layer 3 more electrically resistant. When any portion of layer 3, which has been thus destroyed or made electrically resistance, comes near return electrode 7, the currents applied from data-recording electrode 5 flows from ribbon 1 to return electrode 7, concentratedly through narrow undestroyed or low-resistant portions of conductive layer 3. Consequently, a great amount of heat is generated in these narrow portions of layer 3, inevitably softening that portion of base film 2 which lies above the undestroyed or low-resistant portions of layer 3. The softened portion of base film 2 cannot withstand the tension applied on that portion of ribbon 1 which extends between electrode 5 and return electrode 7. As a result, ink ribbon 1 is cut in the vicinity of return electrode 7.

In consideration of these causes of the ink ribbon cutting, the inventors hereof have already proposed, in U.S. Ser. No. 163,394, filed on May 2, 1988, an arrangement in which a return electrode is disposed on the ink-ribbon feeding side of an ink ribbon. According to this proposed arrangement, the resistances between data-recording electrodes and the return electrode can be kept constant at a low level. Therefore, the used portion of the ink ribbon, heated by the recording currents applied from the data recording electrodes, cannot be heated again. Thus, the ink ribbon can be prevented from being cut.

The inventors hereof conducted a further study on the above proposal, and found out the following facts. Besides the first return electrode located on the ribbon feeding side of the ink ribbon, with respect to the data-recording electrodes, a second return electrode may be disposed on the ribbon take-up side of the ribbon. According to this arrangement, the resistances between the data-recording electrodes and the return electrodes are connected in parallel between the data-recording electrodes and the ground. Equivalently, therefore, the total resistance between the data-recording electrodes and the ground can be reduced, so that the ink ribbon cutting can be more securely prevented even in high-speed printing operation. In order to prevent the ribbon cutting, moreover, the impedance of a first current path, which extends from the data-recording electrodes through the first return electrode to the ground, is made lower than that of a second current path, which extends from the data-recording electrodes through the second return electrode to the ground. By setting the first and second current paths in this manner, a current flow through the second current path can be prevented from becoming so large that the ink ribbon is heated under the second return electrode.

According to the invention, there is provided an electrothermal printing apparatus for transferring ink onto a recording medium, thereby to record data on he recording medium, said apparatus comprising:

an ink ribbon including a base film being electrically resistive and having first and second surfaces, an electrically conductive layer formed on the first surface of the base film, and an ink layer formed on the conductive layer, and having a surface to face and contact with the recording medium;

ribbon-feeding means for feeding said ink ribbon in a first direction;

current-supplying means contacting with the second surface of the base film for supplying a signal current to the electrically conductive layer through the base film, thereby to generate heat in the base film, thereby to transfer ink to the recording medium from the ink layer; and current-collecting means for collecting the signal current supplied from said current-supplying means to the electrically conductive layer, which includes first and second electrodes located upstream and downstream of said first direction with respect to said current-supplying means, respectively, contacting with the second surface of the base film and connected to the ground, a first current path which has a first impedance being defined by the base film, the conductive layer and the first electrode, a second current path which has a second impedance being defined by the base film, the conductive layer and the second electrode, the signal current flowing though the first and second current paths into the ground, respectively, and the first impedance being smaller than the second impedance.

DETAILED DESCRIPTION OF THE PREFERRED EMBODIMENTS

Figure 2:
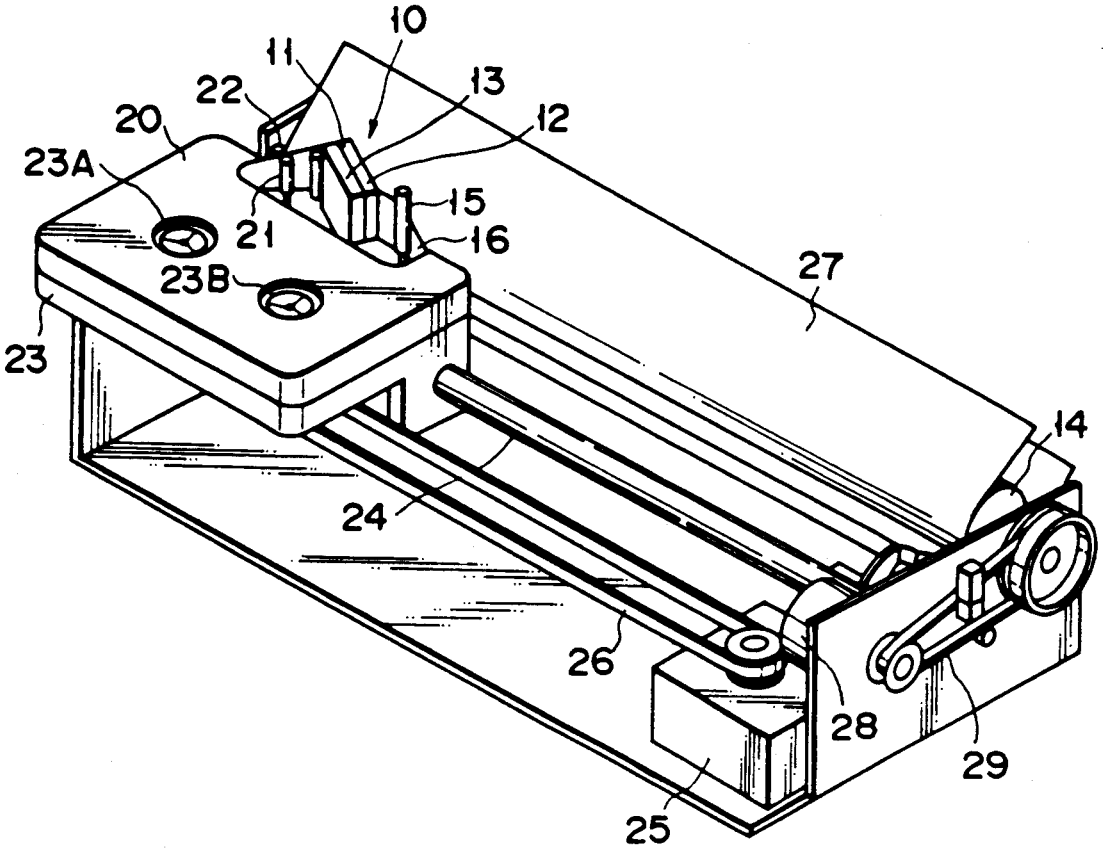
FIG. 2 is a perspective view of an electro, serial thermal printer according to a first embodiment of the present invention.
Figure 3:
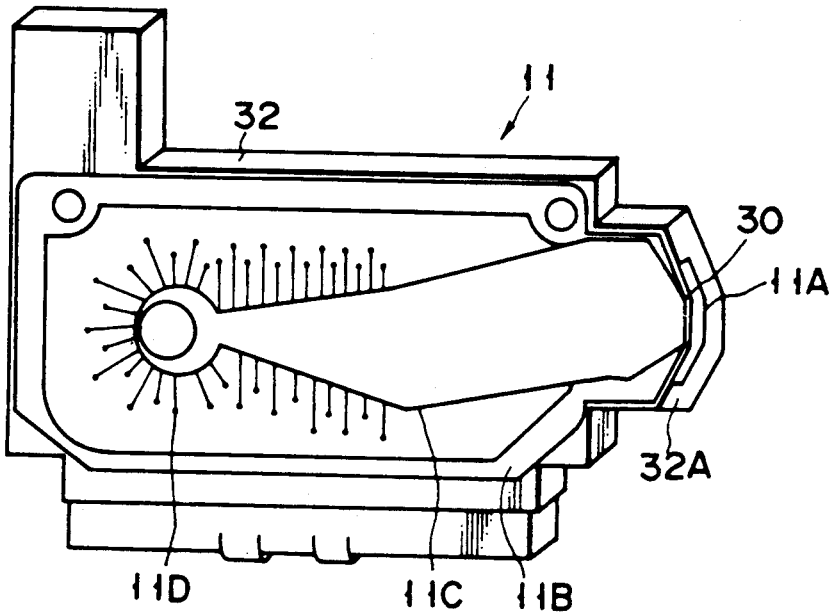
FIG. 3 is a perspective view schematically illustrating the recording head assembly used in the thermal printer shown in FIG. 2.

FIG. 2 is a perspective view showing a serial thermal, or an electrothermal recording apparatus according to an embodiment of the present invention. This serial printer has recording head 11 which is illustrated in detail in FIG. 3. Recording head 11 is opposed to platen 14. It has 50 data-recording electrodes 30, as is shown in FIG. 3. These data-recording electrodes 30 are arranged parallel to one another such that their tips are aligned in a vertical line extending at right angles to the direction in which ink ribbon 16 is fed, in the density of 12 electrodes per millimeter. These recording electrodes 30 are provided within housing 32 made of plastics. Their tips are connected to silicone rubber layer 11A attached to head-supporting section of housing 32. The proximal ends of electrodes 30 are electrically connected to conductive pads 11D formed on polyimide film 11B by means of conductive patterns 11C formed also on polyimide film 11B which in turn is formed on side of housing 32.

As is shown in FIG. 2, recording head 11 is detachably supported by head holders 12 and 13. When head 11 is attached to head holders 12 and 13, the conductive pads 11D are automatically connected to the conductive pads (not shown) of head holder 12. Since the conductive pads of head holder 12 are coupled to signal-generating circuit 31 shown in FIG. 4, conductive pads 11D are electrically connected to signal-generating circuit 31.

Recording head 11 and head holders 12 and 13 constitute head assembly 10. To record data on paper 27 wrapped around platen 14, head assembly 10 is pressed onto paper 27 by head-urging means (not shown). Head assembly 10 is released from paper 27 upon recording data on paper 27. The force for pressing head assembly 10 onto paper 27 is appropriately controlled. This is because ink traces will be formed on paper 27, extending from each printed character, when this force is greater than necessary.

First return electrode 15 is located upstream of the ribbon-feeding direction and second return electrode 21 is located downstream of the ribbon-feeding direction, with respect to head assembly 10. In other word, first return electrode 15 is located to contact the unused portion of ink ribbon 16 and second return electrode 21 is located to contact the used portion of ink ribbon 16. First return electrode 15 is connected to the ground through earth line (not shown) and second return electrode 21 is connected to the ground through resistor 51 having predetermined resistance, for example, resistance of 1 kΩ. Accordingly, data recording electrode 30 is connected to the ground through first and second current paths, first current path being defined by data recording electrode, ink ribbon 16, first return electrode 15 and the ground, and second current path being defined by data recording electrode, ink ribbon 16, second return electrode 21, resistor 51 and the ground. The first current path is so formed as to have an impedance smaller than that of the second current path.

Figure 4:
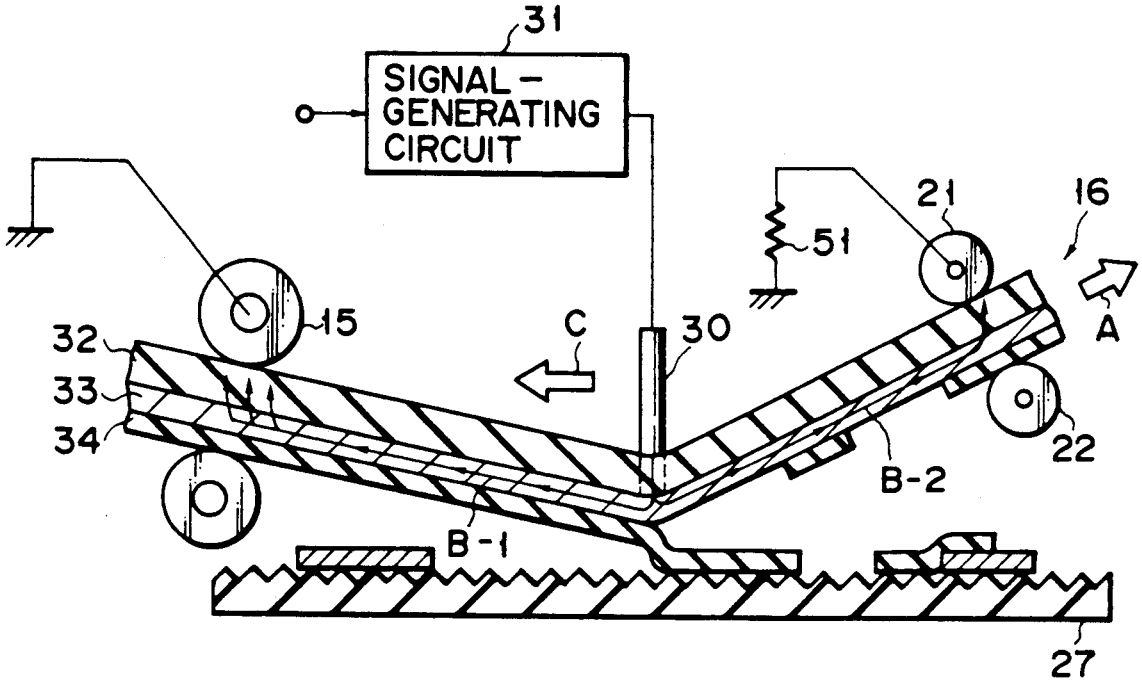
FIG. 4 is a diagram schematically showing the basic structure of the thermal printer shown in FIG. 2.
Figure 5:
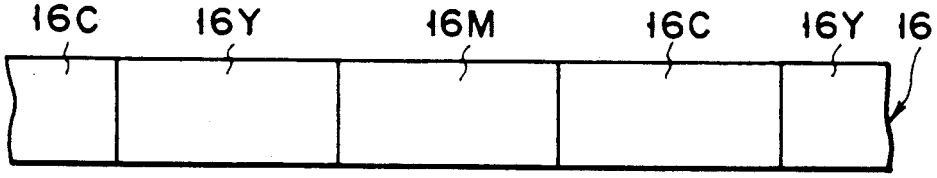
FIG. 5 is a plan view showing a color ink ribbon used in the thermal printer shown in FIG. 2.

Ink ribbon 16 is received in ribbon cassette 20, in the form at a roll. As is shown in FIG. 4, ink ribbon 16 is comprised of electrically resistive base film 32, electrically conductive layer 33 formed on resistive layer 32, and solid ink layer 34 coated on conductive layer 33. Resistive base film 32 has a thickness of about 16 μm and is made of polycarbonate containing carbon particles dispersed therein. Conductive layer 33 is an aluminum film vapor-deposited on base film 32 and has a thickness of about 0.1 μm. Solid ink layer 34 will be melted when heated to a certain temperature, its thickness is about 6 μm. If ink ribbon 16 is a color ink ribbon, ink layer 34 thereof is divided into three regions of the same length in the longitudinal direction of the ribbon. These regions include yellow region 16Y, magenta region 16M, and cyan region 16C, and this group of regions is arranged repeatedly, as shown in FIG. 5.

Return electrode 21, which serves as a pinch roller, constitutes, in conjunction with pinch roller 22 opposed thereto, a ribbon-feeding mechanism for feeding the ink ribbon.

Head assembly 10, return electrode 15, ribbon cassette 20, and the ribbon-feeding mechanism (21, 22) are mounted on carriage 23. Carriage 23 is slidably mounted on guide bar 24 which horizontally extends and is parallel to platen 14. Carriage 23 is connected to timing belt 26. Timing bet 26 is stretched between a pulley (not shown) provided in the left end section of the serial thermal printer, and the pulley fastened to the shaft of carriage-driving motor 25 provided in the right-end section of the printer. Since timing belt 26 is wrapped around both pulleys, carriage 23 is moved to the left or right, along platen 14, when the shaft of motor 25 rotates in one direction or the other.

Platen-driving motor 28 is provided in the right-end section of the serial thermal printer. A pulley is fastened to the shaft of this motor 28. Timing belt 29 is stretched between, and wrapped around, this pulley and the pulley connected to the right end of platen 14. When motor 28 rotates in one direction or the other, platen 14 is rotated to feed paper 27 forward or backward. Paper 27 is, for example, PPC paper having smoothness of about 20 sec.

The operation of the serial thermal printer shown in FIG. 2 will now be explained.

When the power-supply switch (not shown) of the printer is turned on, carriage 23 is automatically moved to its home position, i.e., to the left end of guide bar 24. Carriage 23 is moved from the home position to the print-start position when motor 25 drives timing belt 26 in response to a print-start signal supplied from a drive signal-generating circuit (not shown). In the meantime, the head-urging mechanism presses recording head 11 and paper 27, with ink ribbon 16 interposed between head 11 and paper 27. Hence, paper 27 is pressed onto platen 14. In this condition, head 11 can print data on paper 27. After carriage 23 has moved to the print-start position, signal-generating circuit 31 (FIG. 4) supplies data signals to recording head 11, and motor 25 is driven at the same time, thereby to move carriage 23 to the right from the print-start position at the speed of about 6 in/sec. Therefore, recording head 11 starts printing data on paper 27. Meanwhile, ink ribbon 16 is fed to the left by pinch rollers 21 and 22, at the speed same as carriage 23 is moved to the right.

With reference to FIG. 4, it will be explained how the data is recorded on paper 27 wrapped around platen 14.

As is shown in FIG. 4, recording head 11 faces paper 27. Ink ribbon 16 is interposed between paper 27 and data-recording electrodes 30. Electrodes 30 are moved in the direction of arrow C as carriage 23 is driven in the same direction. Data-recording electrodes remain in contact with resistive base film 32 of ribbon 16 while being thus moved. As data signals are supplied to electrodes 30 from signal-generating circuit 31 via conductive pads 11D and conductive patterns 11C, data currents corresponding to these signals flow from electrodes 30 to base film 32. These currents flow through those portions of base film 32 which contact electrodes 30, whereby Joule heat is generated in these portions of film 32. The heat is transferred via conductive layer 33 to those portions of solid ink layer 34 which opposes the heat-generating portions of base film 32. These portions of ink layer 34, therefore, melt into ink drops. The ink drops stick onto paper 27, whereby data is printed thereon.

The data currents further flow to return electrodes 15, 21 through conductive layer 33 and that portions of base film 32 which contact return electrodes 15 and 21, as is indicated by arrows B-1, B-2. Hence, Joule heat is generated also in these portions of resistive base film 32. Nonetheless, this heat is not sufficient to melt those portions of ink layer 34 which faces said portion of base film 32, since the data currents are far less concentrated in this portion of film 32, which is large, than in those portions of film 32 which contact data-recording electrodes 30.

The currents supplied from data-recording electrodes 30 flow through the first and second current paths to the ground, as indicated by arrows B-1 and B-2. Since the impedance of the second current path is greater than that of the first current path, as described before, most of the currents flow through the first current path, leaving only a small current flow to the second current path. According to an actual measurement made by the inventors hereof, resistance Ra of the first current path, which includes first return electrode 15, was 200 to 400 Ω, while resistance Rb of second current path, which includes second return electrode 21, was 1,200 to 1,400 Ω. Thus, the currents from data-recording electrodes 30 are distributed to the first and second current paths in the ratio 2:7 to 12.

Meanwhile, those portions of the conductive layer damaged by heating are advanced toward second return electrode 21. As seen from the recording-current distribution ratio, most of the recording currents in the serial printer of this invention flow through the side of first return electrode 15, i.e., through the conductive layer in contact with the resistive base film which is not energized or heated. Accordingly, that portion of the conductive layer which is located under the first return electrode never fails to be undamaged. Thus, fixed conditions can be maintained without regard to the driving conditions for the recording electrodes, including the number of simultaneous drives, the conduction intervals, and the size of recording currents of the recording electrodes. In the prior art apparatus, all-mark recording may cause excessive heating due to current concentration in the resistive base film under the return electrode. It was ascertained however that the apparatus of this invention would not suffer such excessive heating, and hence, ribbon cutting. That portion of the conductive layer under second return electrode 21 is damaged, and the portion of the base film adjacent thereto is subjected to a concentration of the incoming recording currents. Since these recording currents are only part of the whole recording currents, however, the heating effect is small, and the ink layer cannot be heated to so high a temperature that it becomes sticky. With use of the two feedback paths for the recording currents, as compared with the single feedback path for the prior art apparatus, the equivalent load resistance can be reduced. If resistances Ra and Rb of the first and second paths are $R_1$ and $kR_1$ ($k>1$), load resistance $R_0$ of the apparatus of the invention is given by $R_0=\{k/(1+k)\}\cdot R_1$. Since we have $k/(1+k)<1$, the recording electrodes can be driven with a lower load resistance than in the case of the conventional apparatus, so that the driving voltage can be reduced. The reduction of the driving voltage, attributable to the reduced load resistance, particularly benefits the high-speed recording which requires a large recording current flow, and hence, a higher driving voltage, to permit a shorter conduction time, or those apparatuses which use a recording head of a line-head type. The recording head of this type also requires a large recording current flow to supply regular recording currents to a number of recording electrodes, thereby simultaneously driving them. In the printer according to the present invention, writings and images were able to be satisfactorily printed at the speed of 10 inches/sec (recording current of 32 mA for each electrode), without causing the ink ribbon to be cut. In the prior art apparatus shown in FIG. 1, however, the ink ribbon was frequently cut.

The following is a description of the operation of the serial thermal printer shown in FIGS. 2 and 4 with which a color ink ribbon is used.

Figure 6:
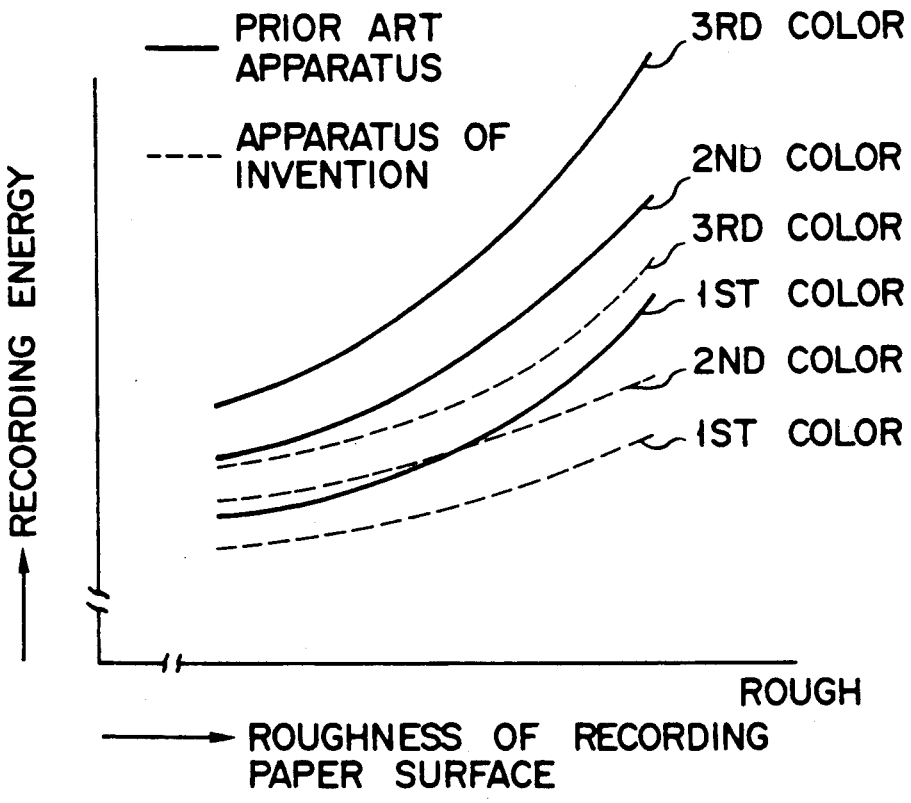
FIG. 6 shows a graph showing a relation between recording energy and roughness of recording paper in a conventional printer and the printer shown in FIG. 2.

When a recording start signal is inputted, the starting end of yellow region 16Y of the resistive color ink ribbon is detected so that yellow recording can be started at a recording start position. Thereupon, recording head 11 in the recording start position is pressed against platen 14. As recording electrodes 30 are actuated in response to a yellow recording signal so that carriage 23 move at a predetermined speed, an electrified yellow coloring material is transferred to recording paper 27, corresponding to the yellow recording signal. When carriage 23 moves along platen 14 so that recording head 11 reaches a recording end position, head 11 is released from platen 14 and returned to the recording start position. In the meantime, the starting end of magenta region 16M is detected. After returning to the recording start position, recording head 11 is pressed again against platen 14, and a magenta coloring material is transferred to the recording paper or the yellow coloring material, in response to a magenta recording signal, in the same manner as in the transfer of the yellow coloring material. When recording head 11 reaches the recording end position, it is released from platen 14 and returned to the recording start position. In the meantime, the leading end of cyan region 16C is detected. After returning to the recording start position, recording head 11 is pressed again against platen 14, and a cyan coloring material is transferred to the yellow and coloring materials in a superposed manner, in response to a cyan recording signal. When recording head 11 reaches the recording end position, it is released from platen 14 and returned to the recording start position. In the meantime, recording paper 27 is fed for one line as platen 14 rotates. In other words, paper 27 is fed for one line after the three coloring materials are transferred to the paper on the same line. Color recording for an entire page is accomplished by repeating this series of operations. Using the recording apparatus according to the present invention, the individual coloring materials were able to be satisfactorily transferred with the same recording current. By only changing the recording current, satisfactory color recording was able to be made on recording papers with various surface roughnesses, e.g., 50, 20, 20, and 8 seconds in terms of Beck's smoothness. When the prior art apparatus was used for the color recording, on the other hand, the ink ribbon was cut. Since the take-up torque for the ink ribbon was extremely small, moreover, the ribbon was often wound up defectively. Thus, as seen from FIG. 6, the rougher the surface of the recording paper, the more difficult the satisfactory recording thereon was. More specifically, in the printer according to the present invention, the energy required for the recording, as shown in FIG. 4, was able to be made smaller enough than the required energy for the prior art printer. When recording paper with 20-second Beck's smoothness was used, as shown in FIG. 6, the recording currents of the prior art apparatus were 45 mA for the first color, 48 mA for the second, and 55 mA for the third. In the case of the apparatus of the present invention, on the other hand, the recording currents were 40 mA for the first color, 42 mA for the second, and 47 mA for the third.

It was ascertained that the recording apparatus of the present invention can produce the same effect when a sublimable material is used in place of the thermoplastic material, as the coloring material for the resistive ink ribbon.

Figure 7:
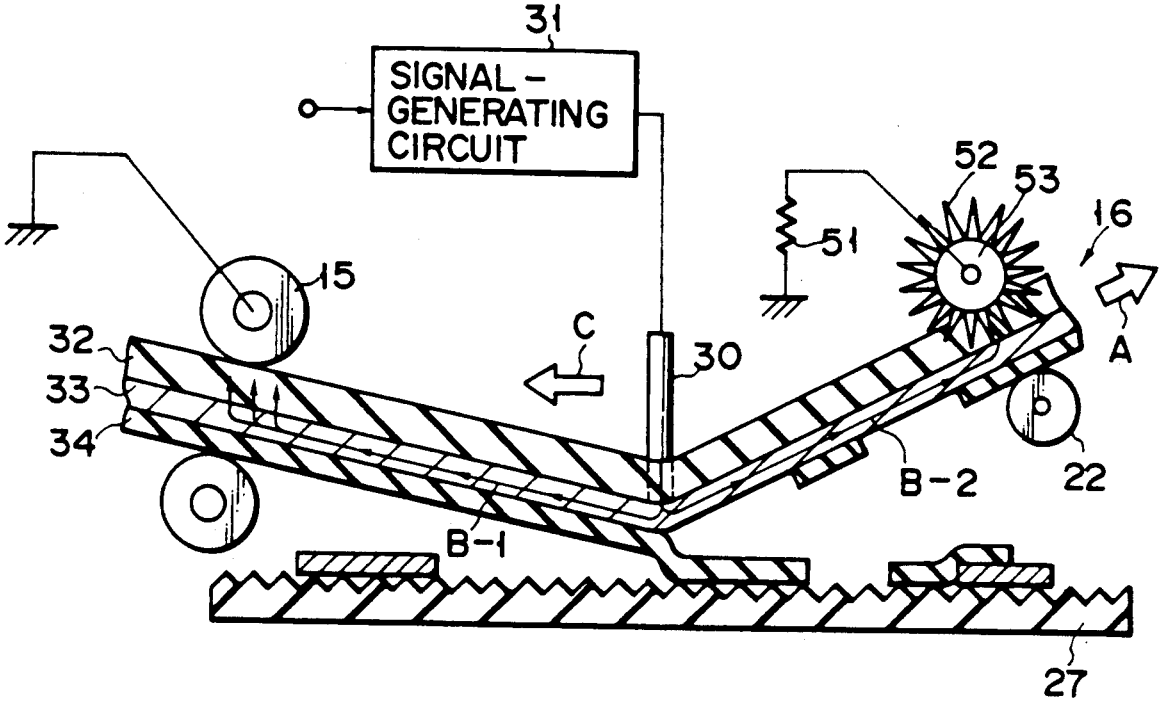
FIG. 7 is a diagram schematically showing a thermal printer according to embodiment of the invention.

Referring now to FIG. 7, another embodiment of the present invention will be described. In FIG. 7, like reference numerals are used to designate like portions as in FIG. 4, and a description of these portions is omitted herein. In a recording apparatus shown in FIG. 7, return electrode 53, which has projections 52 capable of reaching conductive layer 33 of resistive ink ribbon 16, is used in place of return electrode 21 of the serial printer shown in FIGS. 2 and 4. The recording operation of the apparatus of this second embodiment is performed in the same manner as that of the printer shown in FIGS. 2 and 4, so its description is omitted herein. As seen from the arrangement shown in FIG. 7, the apparatus of the second embodiment can produce the same effect of the printer according to the first embodiment. In the apparatus of FIG. 7, moreover, projections 52 of return electrode 53 contact directly with conductive layer 33, so that the resistive base film portion under electrode 53 can never be heated.

Figure 8:
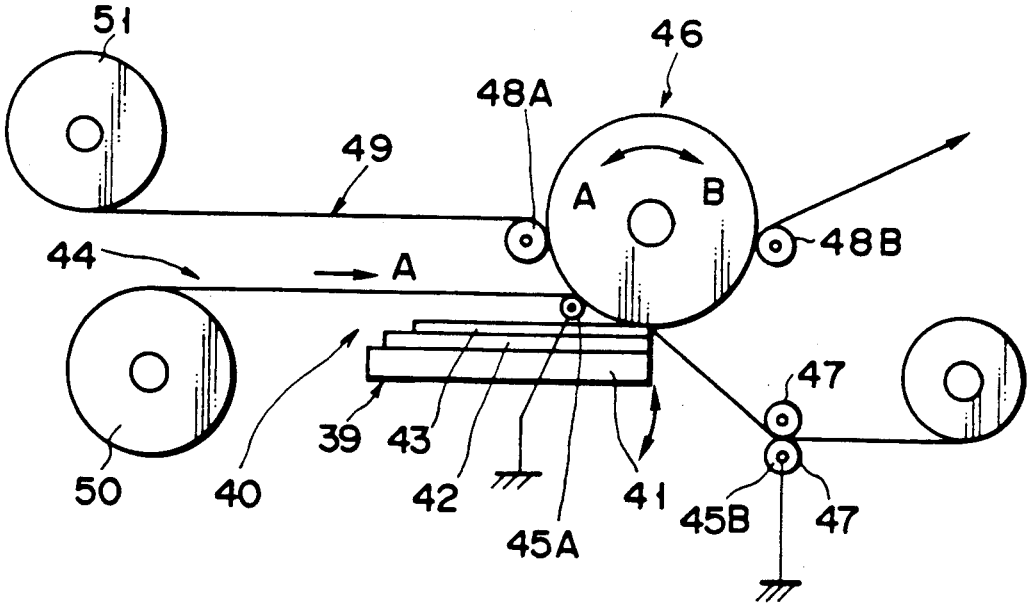
FIG. 8 is a diagram schematically showing a thermal printer according to a further embodiment of the invention.

Referring now to FIG. 8, still another embodiment of the present invention will be described. FIG. 8 is a diagram schematically showing a color line printer according to the invention. In FIG. 8, numeral 39 designates a recording head assembly, which is composed of recording head 40 and recording head support base 41. Head 40 is a recording head of a line-head type, which includes a recording head base 42 of aluminum and 1,920 recording electrodes 43 of tungsten arranged thereon at a density of 8 electrodes/mm. Numeral 44 designates a resistive color ink ribbon composed of a resistive base film of 90-mm width, a conductive layer, and a color ink layer, none of which are illustrated. Ribbon 44 is located so that the base film is in contact with recording electrodes 43. The color ink layer, like the coloring material layer of the ink ribbon shown in FIG. 5, includes yellow, magenta, and cyan regions which, carrying a single sublimable coloring material each, are arranged repeatedly. Numerals 45A and 45B designate return electrodes, which are disposed on the unused and used sides, respectively, of ink ribbon 44, with respect to recording head 39, and are grounded.

Return electrode 45A is located so that the portion of color ink ribbon 44 between electrode 45A and the position where the recording current from recording electrodes 43 is applied to the resistive base film is shorter than the ribbon portion between return electrode 45B and the position for the current application. In the printer of this embodiment, the ratio between the respective lengths of the former and latter ribbon portions, on the sides of return electrodes 45A and 45B respectively, is 1:5. Electrode 45A also serves to press ink ribbon 44 against platen roller 46, thereby holding the ribbon on the peripheral surface of roller 46 lest the ribbon be wrinkled before it touches recording electrodes 43. Numeral 47 designates a follow roller which serves to hold ink ribbon 44 in engagement with return electrode 45B. Roller 47, which is coupled to a ribbon drive power system (not shown), engages electrode 45B to transport ribbon 44. Numerals 48A and 48B designate a pair of guide rollers which hold recording paper 49 along the peripheral surface of platen roller 46.

Recording paper 49 has a sublimable coloring material receiving layer (not shown) on its surface, and is disposed so as to face the color ink layer of color ink ribbon 44.

The operation of the printer of this embodiment will now be described. Color ink ribbon 44 delivered from color ink ribbon supply reel 50 is pressed against platen roller 46 by return electrode 45A, and its yellow region is detected by color detecting means (not shown) and driven by means of a pair of rubber rollers, to be set in position for the start of recording. Thus, the leading end of the yellow region contacts with recording electrodes 43 and the resistive base film of ribbon 44, and is aligned at the recording region where the recording current is applied. Recording paper 49 supplied from recording paper supply reel 51 is held on the peripheral surface of platen roller 46, including the recording region, by guide rollers 48A and 48B. When roller 46, paper 49, ribbon 44, and electrodes 43 are pressed against one another, a recording current corresponding to a yellow recording signal is selectively supplied at a pulse period of 2 ms by recording electrode drive means (not shown), which is connected to recording electrodes 43. The supplied recording current is caused to flow through both return electrodes 45A and 45B, with a magnitude inversely proportional to the extent of the ink ribbon to the return electrodes. On the side of return electrode 45B, the conductive layer is damaged, as mentioned before, so that the flowing recording current is further reduced. Most of the recording current flows through return electrode 45A on which the conductive layer is not damaged. The effect of the recording current flow through electrode 45A on the unused side of color ink ribbon 44, the effect of the use of the two recording current feedback paths, and the ink transfer operation are the same as those described in connection with the foregoing embodiment.

Under recording electrodes 43, the yellow coloring material is adhered to recording paper 49 by the same recording operation as described in connection with the foregoing embodiment. When energization for an entire line ends, color ink ribbon 44 and paper 49 is fed for the line as platen roller 46 and rubber roller 47 rotate. A recording current corresponding to a recording signal for the next line is supplied to the recording electrodes, so that yellow recording is operated in the aforementioned manner. These operations are repeated until yellow recording for an entire page is finished. As the recording advances, ink ribbon 44 and recording paper 49 are separated from each other at the edge portion of recording head 40. More specifically, ribbon 44 is transported toward rubber roller 47, while paper 49 is guided along the peripheral surface of platen roller 46 by the action of guide roller 48B. Thus, the yellow coloring material is transferred to paper 49. During this recording operation, color ink ribbon 44, fed under recording electrodes 43, is pressed, together with paper 49, against platen roller 46 by return electrode 45A. Accordingly, wrinkling can be restrained even if there is imbalance (liable to cause wrinkling) in tension across the width of the ink ribbon, between electrode 45A and ink ribbon supply reel 50. Between return electrode 45A and the recording region, moreover, ink ribbon 44, along with recording paper 49), is pressed against platen roller 46, to be kept intimately in contact with the peripheral surface thereof, by electrode 45A and recording head 40. Thus, wrinkling cannot be caused at all. After the end of the yellow recording, recording head assembly 39 is disengaged from platen roller 46 by recording head assembly control means (not shown). Then, ink ribbon 44 is fed in the direction of arrow A so that the leading end of the magenta region is set in position for the start of recording. As platen roller 46 rotates reversely in the direction of arrow B, recording paper 49 is returned while being held on the peripheral surface of roller 46 by the agency of guide rollers 48A and 48B. Thus, the head of the recording area of the paper is set in position for the start. After the setting of the magenta region and the recording area, head assembly 39 is pressed again against platen roller 46 by the head assembly control means. Thus, magenta recording is performed in the same manner as the yellow recording. Cyan recording is also effected by repeating these operations, thereupon the color recording is completed. In this manner, recording on a recording area of 78 mm by 100 mm was able to be actually accomplished in about 5 seconds.

Figure 1:
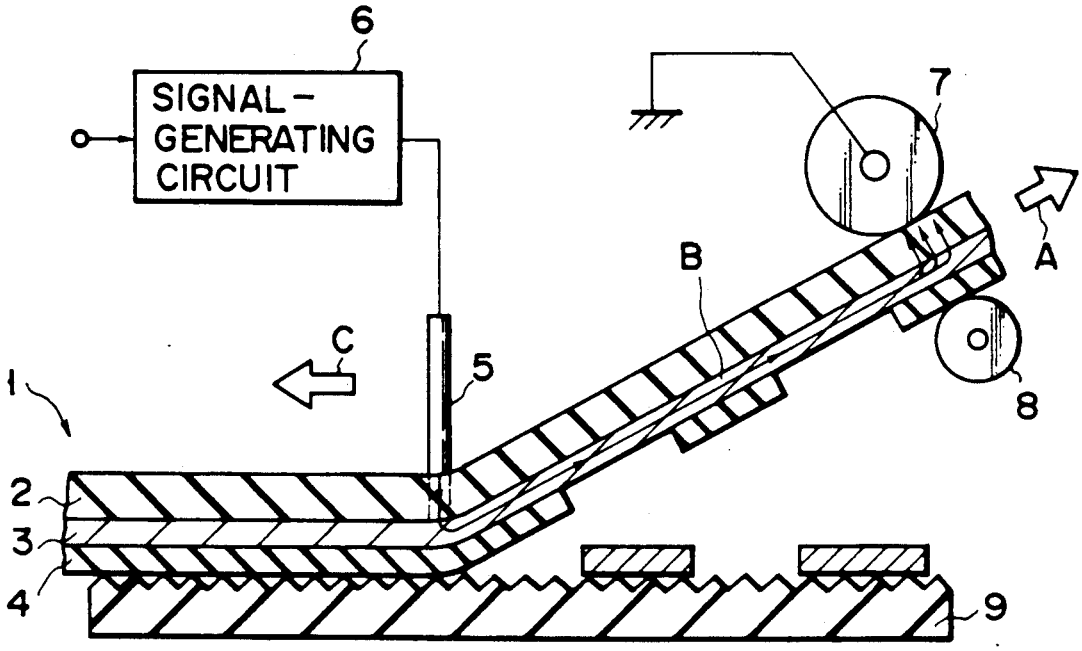
F I G. 1 PRIOR ART
FIG. 1 is a diagram schematically showing a conventional electro, serial thermal printer.

According to the arrangement of the prior art apparatus shown in FIG. 1, in which only electrode **45*b*** is used as the return electrode, the density was gradually reduced during the all-mark recording, even though the recording electrodes were driven separately for the formation of one line. When the density was not reduced, the ink ribbon was often cut. According to the line printer of the present embodiment, on the other hand, when all sorts of patterns were recorded with the ribbon/paper feeding speed of 8 inches/sec, stable density was obtained, and the ink ribbon was never cut at all.

The aforementioned embodiment is an example of an electrothermal recording apparatus according to the present invention. It is to be understood that the way of applying impedance across and between the recording electrodes, the return electrodes, and the ground is not limited to the method described in connection with the above embodiment. In the above described embodiments, first and second electrodes 15, 21, 53, 45A, 45B are connected to the ground and the data recording electrode 30 or 43 is connected to signal generating circuit 31 so that signal current is supplied from data recording electrode 30 or 43 to first and second electrodes 15, 21, 53, 45A, 45B through ink ribbon 16. However, first and second electrodes may be connected to signal generating circuit and data recording electrode may be connected to the ground. In this modification, signal current is supplied from first and second return electrodes to data recording electrode through ink ribbon and a heat is also generated in ink ribbon under data recording electrode in a same manner as described above.

The circuit arrangement and operation of the signal-generating circuit are described in U.S. Ser. No. 163,394.

In the color line printer according to this embodiment, the recording paper is swung so that the color ink ribbon is superposed thereon. It is to be understood, however, that the present invention may be also applied to a color line printer in which the recording paper is wound around the platen roller, and is rotated in the same direction as the moving direction of the color ink ribbon so that the paper and the ribbon are superposed on each other.

According to the present invention, there may be provided an electrothermal recording apparatus which is free from ink ribbon cutting, and is high in reliability and high speed recording capability. Since the load resistance can be reduced, the recording apparatus of the invention can effect constant-current drive of recording electrodes with a lower driving voltage or a wider operation margin. Further, there may be provided a line printer of an electrothermal recording type which is free from ink ribbon cutting and defective recording attributable to a wrinkled ribbon.

Moreover, there may be provided an electrothermal color recording apparatus of high operating capability which does not require a change of recording energy for each coloring material. Also, there may be provided an electrothermal color recording apparatus which is capable of high-quality color recording even on rough-surfaced recording paper, such as PPC paper. Furthermore, there may be provided an electrothermal recording apparatus which uses a recording head of a line-head type, and can perform high-speed recording of all sorts of images or patterns without entailing ink ribbon cutting or unevenness in density.

What is claimed is:

1. An electrothermal printing apparatus for transferring ink onto a recording medium, thereby to record data on the recording medium, said apparatus comprising:

an ink ribbon including a base film being electrically resistive and having first and second surfaces, an electrically conductive layer formed on the first surface of the base film, and an ink layer formed on the conductive layer, and having a surface to face and contact with the recording medium;

ribbon-feeding means for feeding said ink ribbon in a first direction;

current-supplying means contacting with the second surface of the base film for supplying a signal current to the electrically conductive layer through the base film, thereby to generate heat in the base film and transfer ink to the recording medium from the ink layer;

current-collecting means, contacting with the second surface of the base film, for collecting the signal current supplied from said current-supplying means to the electrically conductive layer, which includes first and second electrodes located upstream and downstream of said first direction with respect to said current-supplying means, respectively, the first electrode being connected to the ground, and a resistor connected between the second electrode and the ground, a first current path including the base film, the conductive layer and the first electrode, and a second current path including the base film, the conductive layer and the second electrode, the signal current flowing through the first and second current path into the ground, respectively.

2. The apparatus according to claim 1, wherein a first distance between said current-supplying means and the first electrode along said ink ribbon is shorter than a second distance between said current-supplying means and the second electrode.

3. The apparatus according to claim 1, wherein the second electrode has projections which penetrate into said ink ribbon and directly contact with the conductive layer.

4. The apparatus according to claim 1, further comprising carriage means for carrying said ribbon-feeding means and said current-supplying means in a second direction substantially opposite to said first direction.

5. The apparatus according to claim 4, wherein said ribbon-feeding means feeds said ink ribbon relative to said current-supplying means at a predetermined speed, and said carriage means carries said ribbon-feeding means relative to said recording medium at a predetermined speed which is substantially equal to the speed at which said ink ribbon is fed by said ribbon-feeding means.

6. The apparatus according to claim 1, wherein said ink ribbon has different color ink regions which are repeatedly arranged along said ink ribbon.

7. The apparatus according to claim 1, further comprising recording medium-feeding means for feeding the recording medium in a direction perpendicular to said first direction.

8. The apparatus according to claim 1, wherein said current-supplying means includes a plurality of electrodes arranged in a direction at right angles to said first direction.

9. The apparatus according to claim 1, wherein said current-supplying means includes means for supplying signal currents to said electrodes.

10. The apparatus according to claim 1, further comprising recording medium-feeding means for feeding the recording medium in the first direction.

11. The apparatus according to claim 1, wherein the first electrode is so located as to press the ink ribbon on said recording medium-feeding means.

12. An electrothermal printing apparatus for transferring different color ink onto a surface of recording medium, thereby to record different color data on the surface recording medium, said apparatus comprising:

a color ink ribbon movable in a first direction and including a base film being electrically resistive and having first and second surfaces, an electrically conductive layer formed on the first surface of the base film, and a color ink layer formed on the conductive layer, and having different color ink regions and a surface to face and contact with the recording medium;

current-supplying means contacting with the second surface of the base film for supplying a signal current to the electrically conductive layer through the base film, thereby to generate heat in the base film and transfer ink to the recording medium from one of the different color ink regions; 'current-collecting means, contacting with the second surface of the base film, for collecting the signal current supplied from said current-supplying means to the electrically conductive layer, which includes first and second electrodes located upstream and downstream of said first direction with respect to said current-supplying means, respectively, the first electrode being connected to the ground and a resistor connected between the second electrode and the ground, a first current path including the base film, the conductive layer and the first electrode, a second current path including the base film, the conductive layer and the second electrode, the signal current flowing through the first and second current paths into the ground, respectively;

first means for feeding said color ink ribbon in said first direction to transport one of the color ink regions; and second means for relatively feeding said recording medium and said current supplying means after the color ink is transferred to the surface region of recording medium from the one of the color ink regions, thereby to transfer another one of the color ink regions to the same surface region of the recording medium.

13. The apparatus according to claim 12, wherein a first distance between said current-supplying means and the first electrode along said color ink ribbon is shorter than a second distance between said current-supplying means and the second electrode.

14. The apparatus according to claim 12, wherein the different color ink regions are repeatedly arranged along said ink ribbon.

15. The apparatus according to claim 12, wherein the second electrode has projections which penetrate into said color ink ribbon and directly contact with the conductive layer.

16. The apparatus according to claim 12, wherein said second feeding means includes carriage means for carrying said ribbon feeding means and said current-supplying means in a second direction substantially opposite to said first direction.

17. The apparatus according to claim 12, wherein said second feeding means includes means for feeding the recording medium in a third direction substantially perpendicular to said first and second direction, said recording medium feeding means feeding the recording medium for one recording line after the ink is repeatedly transferred to the one recording line from the different color regions.

18. The apparatus according to claim 17, wherein said ribbon feeding means feeds said color ink ribbon relative to said current-supplying means at a predetermined first speed, and said carriage means carries said ribbon feeding means relative to said recording medium at a predetermined second speed which is substantially equal to the first speed.

19. The apparatus according to claim 12, wherein said second feeding means includes means for feeding the recording medium in said first direction while the ink is transferred to the surface region from the one of the color ink regions and feeding the recording medium in a second direction opposite to said first direction after the ink is transferred to the surface region from the one of the color ink regions.

20. The apparatus according to claim 12, wherein the first electrode is so located as to press the color ink ribbon on said first feeding means.

21. The apparatus according to claim 12, wherein said current-supplying means includes a plurality of electrodes arranged in a direction at right angles to said first direction.

* * * * *